United States Patent [19]

Horodysky et al.

[11] 4,328,113

[45] May 4, 1982

[54] FRICTION REDUCING ADDITIVES AND COMPOSITIONS THEREOF

[75] Inventors: Andrew G. Horodysky, Cherry Hill; Joan M. Kaminski, Clementon; Henry Ashjian, East Brunswick; Henry A. Gawel, Clark, all of N.J.

[73] Assignee: Mobil Oil Corporation, New York, N.Y.

[21] Appl. No.: 112,025

[22] Filed: Jan. 14, 1980

[51] Int. Cl.[3] ..... C10M 1/54

[52] U.S. Cl. ..... 252/49.6; 252/50; 564/8

[58] Field of Search ..... 252/49.6, 50

[56] References Cited

U.S. PATENT DOCUMENTS

| | | | |
|---|---|---|---|
| 2,999,064 | 9/1961 | Sluhan | 252/49.6 X |
| 3,007,873 | 11/1961 | Reynolds et al. | 252/49.6 |
| 3,014,869 | 12/1961 | Reynolds et al. | 252/49.6 |
| 3,014,870 | 12/1961 | Reynolds et al. | 252/49.6 |
| 3,076,835 | 2/1963 | Kay et al. | 252/49.6 X |
| 3,254,025 | 5/1966 | LeSuer | 252/49.6 X |
| 3,338,834 | 8/1967 | Abbott | 252/49.6 |
| 3,449,362 | 6/1969 | Lee | 252/49.6 X |
| 3,598,855 | 8/1971 | Lyba | 252/49.6 |
| 3,634,248 | 1/1972 | Andress | 252/49.6 |
| 3,645,901 | 2/1972 | Matson | 252/49.6 |
| 3,697,426 | 10/1972 | Lowe | 252/50 |
| 3,708,422 | 1/1973 | Swanson | 252/49.6 |
| 3,751,365 | 8/1973 | Piasek et al. | 252/49.6 |
| 3,814,212 | 6/1974 | Latos | 252/50 |
| 4,022,713 | 5/1977 | Waldstein | 252/49.6 |
| 4,025,445 | 5/1977 | Hellmuth et al. | 252/49.6 |
| 4,060,491 | 11/1977 | Bridger et al. | 252/50 |
| 4,226,734 | 10/1980 | Schuster | 252/49.6 X |
| 4,273,665 | 6/1981 | Braid et al. | 252/49.6 |

OTHER PUBLICATIONS

"Motor Oils & Engine Lubrication", by Georgi, New York, 1950, p. 209.

*Primary Examiner*—Thomas A. Waltz

*Attorney, Agent, or Firm*—Charles A. Huggett; Michael G. Gilman; James D. Tierney

[57] ABSTRACT

Alkyl amines, alkyl diamines and borated adducts of alkyl amines and diamines are effective friction reducing additives when incorporated into lubricating oils.

13 Claims, No Drawings

FRICTION REDUCING ADDITIVES AND COMPOSITIONS THEREOF

BACKGROUND OF THE INVENTION

1. Field of the Invention

This invention relates to lubricant compositions and, more particularly, to lubricant compositions comprising oils of lubricating viscosity or greases thereof containing a minor friction reducing amount of a hydrocarbyl amine, a hydrocarbyl diamine, a borated adduct of said amine or diamine or mixtures thereof.

2. Description of the Prior Art

Many means have been employed to reduce overall friction in modern engines, particularly automobile engines. The primary reasons are to reduce engine wear thereby prolonging engine life and to reduce the amount of fuel consumed by the engine thereby reducing the engine's energy requirements.

Many of the solutions to reducing fuel consumption have been strictly mechanical, as for example, setting the engines for a leaner burn or building smaller cars and smaller engines. However, considerable work has been done with lubricating oils, mineral and synthetic, to enhance their friction properties by modifying them with friction reducing additives.

Amines and amine adducts have found widespread use as lubricating oil additives and especially as intermediates in the formation of lubricating additives. It has now been found that certain hydrocarbyl amines and diamines and their borated derivatives can impart significant friction reducing characteristics to lubricants when incorporated therein. So far as is known the use of the amine and amine products in accordance with this invention as friction modifiers has not been disclosed or suggested by any prior reference or combination of references, patent or literature.

SUMMARY OF THE INVENTION

This invention is more particularly directed to hydrocarbyl amines and borated adducts thereof, wherein hydrocarbyl includes alkyl, cycloalkyl, aryl and alkaryl. Also included are diamines and primary, secondary and tertiary amines. The amines generally have from about 8 to 29 carbon atoms.

The invention is also directed to lubricant compositions having reduced friction containing such amines and/or borated derivatives thereof and to a method of reducing fuel consumption in internal combustion engines by treating the moving surfaces of the engines with said lubricant composition. This invention is further directed to lubricant compositions wherein improved oxidative stability and reduced bearing corrosion are provided by the borated adducts embodied herein.

DESCRIPTION OF SPECIFIC EMBODIMENTS

The amines useful in this invention include long chain amines such as oleyl amine, stearyl amine, isostearyl amine, dodecyl amine, secondary amines such as N-ethyloleyl-amine, N-methyl-oleyl-amine, N-methyl-soya-amine and di(hydrogenated tallow) amine and diamines such as N-oleyl-1,3-propylenediamine, N-coco-1,3-propylenediamine, N-soya-1,3-proylenediamine and N-tallow-1,3-propylenediamine. The borated products useful in this invention accordingly include the above-described amines which have been subjected to boration.

The borated derivatives may be prepared by treating the amines or diamines with boric acid preferably in the presence of an alcoholic or hydrocarbon solvent. The presence of a solvent is not essential, however, if one is used it may be reactive or non-reactive. Suitable non-reactive solvents include benzene, toluene, xylene and the like. Suitable reactive solvents include isopropanol, butanol, the pentanols and the like. Reaction temperatures may vary from about 70° to 250° C. with 110° to 170° C. being preferred. Generally stoichiometric amounts of boric acid are used, however, amounts in excess of this can be used to obtain compounds of varying degrees of boration. Boration can therefore be complete or partial. Boration levels may vary in the instant compounds from about 0.05 to about 7 wt. %. The amines or diamines embodied herein may be borated by any means known to the art, for example, through transesterification with a trihydrocarbyl or a trialkyl borate such as tributyl borate. In general borated adducts possess even greater friction reducing properties than similar non-borated derivatives; see the Table. For example, as little as 0.2 wt. % of a borated amine may reduce friction of a fully blended automotive engine oil by as much as 24–32% as compared to 16–20% for a non-borated additive. As noted hereinabove the borated derivatives not only provide improved oxidative stability but also improve corrosion inhibition.

The lubricants contemplated for use herein include both mineral and synthetic hydrocarbon oils of lubricating viscosity, mixtures of mineral and synthetic oils and greases prepared therefrom. Typical synthetic oils are: polypropylene, polypropylene glycol, trimethylol propane esters, neopentyl and pentaerythritol esters, di(2-ethyl hexyl) sebacate, di(2-ethyl hexyl) adiptate, dibutyl phthalate, polyethylene glycol di(2-ethyl hexanoate), fluorocarbons, perfluoro-alkyl-polyethers, silicate esters, silanes, esters of phosphorus-containing acids, liquid ureas, ferrocene derivatives, hydrogenated mineral oils, chain type polyphenyls, siloxanes, and silicones (polysiloxanes) fluorosilicones, alkyl-substituted diphenyl ethers typified by a butyl-substituted bis-(p-phenoxy phenyl) ether, and phenoxy phenyl ethers.

Other hydrocarbon oils include synthetic hydrocarbon polymers having improved viscosity indices, which polymers are prepared by polymerizing an olefin, or mixture of olefins, having from 5 to 18 carbon atoms per molecule in the presence of an aliphatic halide and a Ziegler-type catalyst.

The amount of additive in the lubricant compositions may range from 0.1 to about 10% by weight of the total lubricant composition. Preferred is from about 0.5 to 5 wt. %.

Generally speaking the subject amine compounds are obtained from standard commercial sources or they may be prepared and/or borated by any of a number of conventional methods known in the art.

Having described the invention in general terms, the following are offered to specifically illustrate this development. It is to be understood they are illustrations only and that the invention is not thereby limited except as by the appended claims.

The following examples are typical of the additive compounds useful herein and their test data serve to demonstrate their effectiveness in lubricant compositions for reducing friction and conserving fuel.

Example 1 is oleyl amine and Example 2 is N-oleyl-1,3-propylenediamine. Both were obtained from readily available commercial sources and were thereafter blended into a fully formulated automotive engine oil lubricant.

EXAMPLE 3

Boration of N-oleyl-1,3-propylenediamine

A mixture of N-oleyl-1,3-propylenediamine (350 g), (Example 2), xylol (62.5 g), hexylene glycol (187.5 g), and boric acid (247 g) was refluxed until all water formed in the reaction azeotroped over (max. temperature 210° C.). Solvents were removed under vacuum at 195° C. The product was an orange colored viscous liquid.

EXAMPLE 4

Boration of N-oleyl-1,3-propylenediamine

A mixture of N-oleyl-1,3-propylenediamine (602 g), (Example 2), xylol (108 g), butanol (323 g), and boric acid (425 g) was refluxed until all water formed in the reaction azeotroped over (max. temperature 210° C.). Solvents were removed under vacuum at 195° C. The product was an orange colored viscous liquid.

EXAMPLE 5

Boration of Oleyl Amine

A mixture of oleyl amine (80 g), (Example 1), butanol (33.3 g), and boric acid (6.2 g) was refluxed until all the water formed in the reaction azeotroped over (max. temperature 167° C.). Solvents were removed under vacuum at 100° C. The product was a clear brown colored viscous liquid.

Several blends comprising a minor amount (2 to 4 wt. %) of Examples 1, 2, 3, 4, and 5 and the above described base lubricant were then evaluated using the Low Velocity Friction Apparatus.

EVALUATION OF THE PRODUCT

Low Velocity Friction Apparatus (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in$^2$). Both surfaces are submerged in the test lubricant. Friction between the steel surfaces is measured as a function of the sliding speed at a lubricant temperature of 250° F. The friction between the rubbing surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 30 fpm sliding speed.

Freshly polished steel specimens are used for each run. The surface of the steel is parallel ground to 4 to 8 microinches.

The data obtained is shown in the Table below. The percentages by weight are percentages by weight of the total lubricating oil composition, including the usual additive package. The data are percent decrease in friction according to:

$$\frac{(U_k \text{ of oil alone}) - (U_k \text{ of additive plus oil})}{(U_k \text{ of oil alone})} \times 100$$

The value for the oil alone would be zero for the form of the data shown in the Table.

TABLE

Friction Reduction Evaluations

| Example | Additive Conc. Wt. % | Percent Change in Coefficient of Friction at 5 Ft./Min. | 30 Ft./Min. |
|---|---|---|---|
| Base Oil[a] | — | 0 | 0 |
| 1 | 4 | 16 | 14 |
| 2 | 4 | 20 | 15 |
| 3 | 2 | 27 | 20 |
| 4 | 2 | 24 | 15 |
| 5 | 2 | 32 | 25 |

[a]Base oil comprises fully formulated 5W-20 oil having Kinematic Viscosity @100° C. 6.8 cs, @40° C. 36.9 cs, Viscosity Index 143.

Evaluation: Examples 1 and 2, non-borated amines, and the borated amine adducts, Examples 3 and 4, disclose that significant reduction in the coefficient of friction is provided when the additives in accordance with the present invention are incorporated into a base lubricant blend. It is to be noted that the borated additives provide better friction reduction at 2 wt. % than the non-borated amines provide at 4 wt. %.

A sample of borated N-oleyl-1,3-propylenediamine prepared in a manner similar to Example 3 was evaluated at the 2% additive level in gasoline engine tests. In these tests gasoline engines are run under load with a base lubricant not having additives in accordance with the present invention and then are run under identical conditions with the same base lubricant having a specified minor amount of the novel friction modifiers, etc., described herein. The well known CRC L-38 bearing corrosion test was also performed using this same 2% blend. The results of this 40 hour test disclosed the excellent bearing corrosion inhibiting characteristics of the additives of the present invention and specifically borated N-oleylpropylenediamine; bearing wt. loss=21 mg.

The data detailed herein above confirms that the use of lubricant compositions as disclosed herein provides a significant reduction of friction and a substantial fuel economy benefit to internal combustion engine oils, e.g., automotive engine oil.

It is understood by those of ordinary skill in the art, that departure from the preferred embodiments described herein can be effectively made and that such departure is within the scope of this specification.

We claim:

1. A lubricant composition comprising a major proportion of an oil of lubricating viscosity of grease prepared therefrom, and a minor effective proportion of a friction reducing additive consisting of $C_8$ to $C_{29}$ borated adducts of a hydrocarbyl mono- or diamine and mixtures thereof wherein said hydrocarbyl comprises a member selected from the group consisting of alkyl, alkenyl, alkylene cycloalkyl and mixtures thereof.

2. The composition of claim 1 wherein said additive is borated oleyl amine.

3. The composition of claim 1 wherein said additive is borated N-oleyl-1,3-propylenediamine.

4. The composition of claim 1 wherein said additive is borated N-coco-1,3-propylenediamine.

5. The composition of claim 1 wherein said additive is borated N-soya-1,3-propylenediamine.

6. The composition of claim 1 wherein said additive is borated N-tallow-1,3-propylenediamine.

7. The composition of claims 1, 2 or 3 wherein said oil of lubricating viscosity is a mineral oil.

8. The composition of claims 1, 2 or 3 wherein said oil of lubricating viscosity is a snythetic oil.

9. The composition of claim 1, 2 or 3 wherein said oil of lubricating viscosity is a mixture of synthetic and mineral oils.

10. The composition of claims 1, 2 or 3 wherein said major proportion is a grease.

11. The composition of claim 1 containing from 0.1 to about 10 wt. % of said additive.

12. The composition of claim 11 containing about 2–4 wt. % of said additive.

13. A method of reducing the riction between the moving parts of internal combustion engines, thereby reducing said engines fuel consumption comprising incorporating a minor effective friction reducing amount of a borated hydrocarbyl amine as defined in claim 1 whereby friction reducing characteristics are imparted to said lubricant composition and thereafter treating said internal combustion engine therewith.

* * * * *

UNITED STATES PATENT AND TRADEMARK OFFICE

CERTIFICATE OF CORRECTION

PATENT NO. : 4,328,113

DATED : May 4, 1982

INVENTOR(S) : HORODYSKY ET AL.

It is certified that error appears in the above—identified patent and that said Letters Patent is hereby corrected as shown below:

Column 5, Claim 1, line 2, please change "of" to read —or—.

Signed and Sealed this

*Seventh* Day of *September 1982*

[SEAL]

*Attest:*

GERALD J. MOSSINGHOFF

*Attesting Officer*

*Commissioner of Patents and Trademarks*